US010138616B2

(12) United States Patent
Hu et al.

(10) Patent No.: US 10,138,616 B2
(45) Date of Patent: Nov. 27, 2018

(54) INVERSE CONSTRUCTION METHOD FOR DEEP, LARGE AND LONG PIT ASSEMBLING STRUCTURE OF SUSPENSION-TYPE ENVELOPE ENCLOSURE

(71) Applicant: WUHAN ZHIHE GEOTECHNICAL ENGINEERING CO., LTD, Wuhan, Hubei Province (CN)

(72) Inventors: Yong Hu, Wuhan (CN); Tao Hu, Wuhan (CN); Aihua Yi, Wuhan (CN); Dong Li, Wuhan (CN); Daoyan Peng, Wuhan (CN)

(73) Assignee: WUHAN ZHIHE GEOTECHNICAL ENGINEERING CO., LTD., Wuhan, Hubei Province (CN)

( * ) Notice: Subject to any disclaimer, the term of this patent is extended or adjusted under 35 U.S.C. 154(b) by 0 days.

(21) Appl. No.: 15/623,535

(22) Filed: Jun. 15, 2017

(65) Prior Publication Data

US 2018/0044907 A1 Feb. 15, 2018

(30) Foreign Application Priority Data

Aug. 12, 2016 (CN) ..... 2016 1 0657079
Apr. 18, 2017 (CN) ..... 2017 1 0253027

(51) Int. Cl.
*E02D 7/00* (2006.01)
*E04B 1/18* (2006.01)
(Continued)

(52) U.S. Cl.
CPC ..... *E02D 31/02* (2013.01); *E02D 3/12* (2013.01); *E02D 7/00* (2013.01); *E02D 17/08* (2013.01);
(Continued)

(58) Field of Classification Search
CPC .. E02D 31/02; E02D 3/12; E02D 7/00; E02D 27/14; E02D 17/08; E02D 19/10;
(Continued)

(56) References Cited

U.S. PATENT DOCUMENTS 1,371,709 A * 3/1921 Stockfleth ..... E02D 5/12 405/11
1,447,041 A * 2/1923 Roeth ..... E04B 2/42 52/505
(Continued)

FOREIGN PATENT DOCUMENTS

CN 204040012 U * 12/2014
JP 57000235 A * 1/1982
(Continued)

*Primary Examiner* — Adriana Figueroa
(74) *Attorney, Agent, or Firm* — NK Patent Law

(57) ABSTRACT

The present invention relates to the field of construction of underground buildings, specifically to an inverse construction method for a deep, large and long pit assembling structure of a suspension-type envelope enclosure. A method includes design and calculation; engineering construction of foundation piles; control over underground water; construction of a pit enclosure; building of a basement reinforcing and anti-seeping layer; inverse construction; and floor structure construction. By the inverse construction method for a deep, large and long pit assembling structure of a suspension-type envelope enclosure of the present invention, the pit construction quality is easily controlled, the basement is well waterproofed and easily monitored, and the quality control, service and maintenance are easy.

11 Claims, 10 Drawing Sheets

(51) Int. Cl.

| | |
|---|---|
| ***E02D 31/02*** | (2006.01) |
| ***E02D 3/12*** | (2006.01) |
| ***E02D 19/10*** | (2006.01) |
| ***E02D 17/08*** | (2006.01) |
| ***E02D 27/14*** | (2006.01) |
| ***E04H 6/10*** | (2006.01) |
| ***E04B 1/16*** | (2006.01) |
| ***E04B 5/32*** | (2006.01) |

(52) U.S. Cl.
CPC ..... *E02D 19/10* (2013.01); *E02D 27/14* (2013.01); *E04B 1/16* (2013.01); *E04B 1/18* (2013.01); *E04B 5/32* (2013.01); *E04H 6/10* (2013.01)

(58) Field of Classification Search
CPC . E04B 1/0015; E04B 1/18; E04B 5/02; E04B 5/32; E04B 2/18; E04B 1/16; E04H 6/10
USPC ..... 405/53, 55; 52/169.1, 169.6, 169.9, 570, 52/590.2, 590.3
See application file for complete search history.

(56) References Cited

U.S. PATENT DOCUMENTS 1,829,463 A * 10/1931 Weber ..... E02D 5/14 405/275
2,194,279 A * 3/1940 Goldsborough ..... E02D 5/187 405/149
3,184,893 A * 5/1965 Booth ..... E02D 27/10 405/231
4,290,246 A * 9/1981 Hilsey ..... E02D 27/02 52/125.3
5,114,270 A * 5/1992 Riddle ..... E02D 29/025 256/13
5,944,453 A * 8/1999 Gryba ..... E02D 29/045 405/229
6,220,789 B1 * 4/2001 White ..... E02D 17/08 405/229
6,302,380 B1 * 10/2001 Ultimo, Sr. ..... E02D 3/12 254/228
6,332,303 B1 * 12/2001 Saito ..... E02D 27/14 405/229
7,500,807 B2 * 3/2009 Schmitt ..... E02D 17/04 405/149
7,722,293 B2 * 5/2010 Kruse ..... E02D 17/04 405/133
8,061,108 B2 * 11/2011 Tonyan ..... B28B 5/027 106/735
8,266,862 B2 * 9/2012 Huang ..... E04C 2/044 52/436
8,863,464 B2 * 10/2014 Balducci, Jr. ..... E04B 2/46 52/592.6
2010/0236179 A1 * 9/2010 Kim ..... E04B 2/44 52/578
2014/0150361 A1 * 6/2014 Castonguay ..... E04B 2/26 52/309.4

FOREIGN PATENT DOCUMENTS

JP 03013630 A * 1/1991
JP 03147926 A * 6/1991
JP H0759813 B2 * 6/1995
JP 2640969 B2 * 8/1997
JP 2845060 B2 * 1/1999

* cited by examiner

INVERSE CONSTRUCTION METHOD FOR DEEP, LARGE AND LONG PIT ASSEMBLING STRUCTURE OF SUSPENSION-TYPE ENVELOPE ENCLOSURE

CROSS-REFERENCE TO RELATED APPLICATIONS

This application claims priority to Chinese Patent Application No. 201610657079.4 filed on Aug. 12, 2016, and Chinese Patent Application No. 201710253027.5 filed on Apr. 18, 2017.

BACKGROUND OF THE INVENTION

1. Technical Field

The present invention relates to the field of construction of underground projects, specifically to an inverse construction method for a deep, large and long pit assembling structure of a suspension-type envelope enclosure.

2. Description of Related Art

At present, ternary-structure geological features, similar to Wuhan grade I soil, includes an upper part which is a fine-grained sediment layer of flood land phase, a lower part which is a coarse-grained sediment layer of riverbed phase, and a bottom layer which is a rock-formation geological structure. The traditional basement construction requires that the designed depth of pit enclosure walls reaches the rock formation, which generates a huge cost. Aiming at the construction of underground enclosure structures at alluvious soft layers along rivers and seas and at geological structures with relatively high underground water levels, the following approaches are usually employed to achieve a water-blocking effect and to prevent surrounding soil layers from sedimenting because of water pumping. 1. The anti-seeping curtain extends to the rock formation or other clay waterproof layer, and other support structures such as grouting piles are provided in front of the curtain in accordance with the design requirements. 2. The anti-seeping curtain and the support structures form the integrated cast-in-place underground continuous wall, and the wall extends to the rock formation or waterproof layer also serves as a waterproof and anti-seeping support structure. 3. The soil body is excavated by layers and the internal supports are constructed layer by layer. Such design has the advantage that the anti-seeping runs through the underground continuous wall of the whole soft soil layer, capable of effectively preventing the underground water from bursting into the basement.

However, such construction mode has the following defects: 1. the continuous wall has a large depth, so the construction cost is high, and on the basis of meeting the requirements for preventing bumping at the pit bottom and ensuring stability, the underground continuous wall has a depth which is more than 2-4 times the marking depth; 2. the cast-in-place wall has a relatively large depth, and due to difficulties in control over the verticality and in assurance of the casting quality of large-depth grooves, weak joints are formed between adjacent pieces of the underground continuous walls, which causes potential hazards of water leak and seepage, results in collapse of the surrounding ground and threatens the pit stability. 3. As the scale of the underground project becomes larger and the pit construction time increases, the "time-space effect" is bad for protection of the environment around the pit. 4. Due to an extremely low ratio of the reinforced area of a passive zone to the pit area, the reinforcement of the soil body of the passive zone fails to play a full role of stabilizing the pit. 5. The lateral wall of a fully closed water-proof curtain on the lateral wall of the riverside low-terrace pit bears a large water pressure, and when affected by the geological conditions of the terrace binary structure characteristics, tends to generate seepage or pipe gush which results in excessive sedimentation in surroundings and cause collapse in serious cases to endanger the pit stability. 6. The traditional inverse construction method has low soil excavation efficiency and greatly affects the pit construction efficiency, while the sequence construction method consumes a large amount of templates in the links of dismantling horizontal supports, replacing supports and laying basement floor-slabs and causes huge labor, material and financial expenses to the project.

BRIEF SUMMARY OF THE INVENTION

The objective of the present invention is to provide an inverse construction method for a deep, large and long pit assembling structure of a suspension-type envelope enclosure to solve the problems in the related art. The method can greatly improve the soil excavation efficiency of the inverse construction, realize pre-fabrication of pit components, achieves component assembling construction by adopting the superposing technology, combination technology and other means. Therefore, the method greatly shortens the pit construction time, avoids wastes in labor, material and financial expenses caused by the dismantling link of the sequence construction method, saves project cost, and can effectively reduce effects on the surroundings caused by the "time-space effect" of the pit.

The technical objective of the present invention is achieved by the following technical solution:

An inverse construction method for a deep, large and long pit assembling structure of a suspension-type envelope enclosure includes the following steps:

(I) design and calculation: the pit size and depth of a pit enclosure are determined according to the size of a basement to be constructed, and the thickness of a reinforcing and anti-seeping layer of the basement is determined according to the depth of the pit enclosure and geological conditions;

(II) engineering construction of foundation piles: one-column-one-pile construction is adopted in the pit, wherein the one-column-one-pile refers to an integrated structure of a column pile and an engineering pile, the engineering pile is a grouting pile while the column pile is a steel pipe concrete column pile, the engineering pile is disposed below the column pile, the bottom of the engineering pile is embedded into a waterproof layer or a rock formation, the top of the column pile is constructed to the designed height at one time; during the construction, the verticality of the column pile is ensured, post grouting is carried out at the bottom and the lateral middle portion of the pile to ensure the bearing capability of the column pile and relieve sedimentation;

(III) control over underground water: before the construction of the pit enclosure and the basement reinforcing and anti-seeping layer is completed, the pressure of the underground water controlled to prevent bottom heaving and inrush;

(IV) construction of a pit enclosure: grooves are bored and a continuous wall is formed by mutually assembling splicing-type prefabricated wall boards, grouting is carried out to reinforce the wall after the assembling such that the pit resists stressed deformation and maintains stability, wherein the depth of the splicing-type prefabricated wall boards is greater than the depth of basement floor;

(V) construction of the basement reinforcing and anti-seeping layer: the soil at the bottom of the basement is modified by injecting a grouting material at a high pressure to form a waterproof layer, which is connected with the pit enclosure, as the basement reinforcing and anti-seeping layer, wherein the basement reinforcing and anti-seeping layer and the pit enclosure form a structure with an "H" longitudinal section, meaning that the depth of the basement reinforcing and anti-seeping layer is greater than the depth of the basement floor and smaller than the depth of the pit enclosure;

(VI) inverse construction: the basement is divided into floors $B_0$-$B_{n+1}$ from the ground surface, wherein the floor $B_0$ is dug first, and prefabricated framework beams are set up in the space of the floor $B_0$ after the digging is completed; then the digging of the floors $B_1$-$B_n$ and the setting up of the prefabricated framework beams therein are completed in the same way in sequence; finally, the floor $B_{n+1}$ is dug, and the bottom face of the basement is poured after the digging to form the basement floor;

(VII) construction of a floor structure: construction is carried out upward floor by floor from the floor $B_n$ of the basement, wherein prefabricated concrete superposed floor-slabs or profiled sheet combined floor-slabs are assembled with the corresponding prefabricated framework beams during the construction on each floor, and then concrete is poured onto the prefabricated framework beams to form an integrated floor system and floor, and when the floor strength reaches 80% of the designed strength, the construction is continued upward higher floors.

As an optimization, each one of the splicing-type prefabricated wall boards is provided with splicing portions on two sides; the splicing-type prefabricated wall boards are connected through the splicing portions; each one of the splicing portions is internally provided with a grouting semi-opening; the grouting semi-openings of two adjacent splicing-type prefabricated wall boards are spliced to form a grouting cavity; and each one of the grouting cavities is internally provided with reinforcing steel bars and concrete.

As an optimization, each one of the splicing portions is provided with a splicing strip and a splicing slot which are matched with each other; each one of the splicing-type prefabricated wall boards is formed with an opening in the length direction, and the opening is internally provided with the reinforcing steel bars and the concrete.

As an optimization, the splicing-type prefabricated wall boards include flat-plate-type wall boards and bent-type wall boards.

As an optimization, in step I, the following work needs to be done to determine the depth of the pit enclosure: geological conditions of hydrological and geological engineering need to be researched according to the geological conditions of water-enriched projects near rivers and seas to determine the relationship between the underground water level and the tide of the river and sea water body and the permeability relationships between all soil layers, and then the design number of the floors of the underground structure and the sensitivity of the surroundings are combined to comprehensively determine the embedding depth of the pit enclosure.

As an optimization, the thickness of the basement reinforcing and anti-seeping layer is determined upon the depth of the pit base plate and the distribution characteristics of an underground-floor structure; the position relationship between the waterproof layer and the pit base plate needs to be figured out; in accordance with the results of a water-soil coupling analysis of a seepage flow and the stability requirements of a specification-based approach, the thickness of the waterproof layer below the pit base plate needs to be coordinated with the embedding depth of the wall board of the suspension-type envelope enclosure to ensure the stability design of the pit; the following conditions need to be judged, namely whether the pit base plate passes through the waterproof layer, wherein the worst condition is that the pit base plate does pass through the waterproof layer, and whether the waterproof layer exists in a certain range below the base plate and whether the position of the waterproof layer meets the design requirements; except the case that the waterproof layer with a thickness which meets the design requirements exists below the pit base plate, the soil body in the range of the design depth of the pit bottom needs to be completely grouted for reinforcement and seepage resistance in other conditions.

As an optimization, in step III, the pressure of the underground water is controlled by a method comprising steps of detecting the cover depth and water head height of the confined groundwater in a construction area, controlling the underground water using a precipitation well and inverted well combined technology in conjunction with the depth of the dug pit to prevent bottom heaving and inrush, and during the soil excavation process and before the construction and strength formation of the basement reinforcing and anti-seeping layer, maintaining the pressure of the precipitation well on the confined water layer and keeping working state.

As an optimization, in step IV, a supporting wall groove is dug along the outer line of the pit first using a groove milling machine, then the prefabricated wall boards are assembled in the groove to form an underground continuous wall of which the top is provided with a closed reinforced concrete crown beam; the height and width of the crown beam are determined through calculation while the width is better not smaller than the thickness of the underground continuous wall; the underground continuous wall is constructed by section; the top of the wall is provided with a full-length ring-shaped top beam to strength the integrity of the underground continuous wall; the ring-shaped top beam is better leveled with the soil-ward face of the underground continuous wall to maintain a guide wall which plays a role of blocking the soil body and protecting the slope and avoiding adverse effect on surroundings; the top of underground continuous wall is embedded into the ring-shaped beam by a length of better not smaller than 50 mm, and the length of the longitudinal reinforcing bars that are anchored in the ring-shaped beam is better determined according to tensioning and anchoring requirements.

As an optimization, in step V, the grouting material is injected from the pit top to the position of the basement reinforcing and anti-seeping layer at a high pressure via grouting holes; the grouting holes extend to a position which is 2-4 m below the base plate of the basement; after mud jacking in the grouting holes, the basement reinforcing and anti-seeping layer is formed at the bottom of the basement, and the thickness of the basement reinforcing and anti-seeping layer is 2-3 m.

As an optimization, in step V, during high-pressure grouting, an anti-seeping extension layer is grouted outside the pit enclosure, and the anti-seeping extension layer extends out of the pit by 1-2 m.

As an optimization, in step VI, a stripping alternative bay method is adopted to excavate the soil, and specifically, the soil is excavated by layer and by zone while the soil next to the wall is retained.

As an optimization, in step VI, each one of the prefabricated framework beams consists of a main beam and a secondary beam; the main beam is built into a cross structure; the crossing point of the main beam is disposed at the position of the corresponding one of the column piles; the main beam and the secondary beam are overlapped to form a floor-slab superposing area; each one of the prefabricated framework beams includes a slip formwork moving area; and in step VII, a slip formwork is adopted to install pre-stress concrete superposed floor-slabs or profiled steel combined floor-slabs in the floor-slab superposing area.

As an optimization, each one of the prefabricated framework beam is provided with an assembling pre-embedded parts which are used to be connected with the pre-stress concrete superposed floor-slabs or profiled steel combined floor-slabs.

In conclusion, the present invention has the following beneficial effects:

(1) The inverse construction method for a deep, large and long pit assembling structure of a suspension-type envelope enclosure of the present invention greatly saves building materials and shortens the construction period.

(2) By the inverse construction method for a deep, large and long pit assembling structure of a suspension-type envelope enclosure of the present invention, the pit construction quality is easily controlled, the basement is well waterproofed and easily monitored, and the quality control, service and maintenance are easy.

(3) The inverse construction method for a deep, large and long pit assembling structure of a suspension-type envelope enclosure of the present invention adopts the frame-type supporting floor-slab structure, and employs a huge amount of splicing-type prefabricated parts during construction, simplifying the field construction, enhancing the construction efficiency and ensuring friendly field construction environment.

(4) The inverse construction method for a deep, large and long pit assembling structure of a suspension-type envelope enclosure of the present invention makes a full use of the "time-space effect" principle of the pit and a comprehensive use of the assembling structures, structure combination technology (superposing structure, profited sheet combination) and slip formwork technology, and combines the applications of the geopolymer mortars and a new material, namely high-performance concrete; the construction process and the construction method are innovated to form a new inverse underground structure and a construction process flow, thus under the premise of meeting the deformation control requirement, saving time and cost, speeding up the construction, and achieving the energy-saving and environmentally-friendly effects.

DETAILED DESCRIPTION OF THE INVENTION

The following specific embodiments are merely used to explain the present invention and cannot be regarded as limit to the present invention. Those skilled in the art can make modifications on the embodiments without creative labor after reading the Description, and all the modifications should fall within the protective scope of the Claims of the present invention.

The present invention is described in detail in conjunction with the attached drawings and embodiments.

Embodiment 1:

As shown in FIG. 1-6, an inverse construction method for a deep, large and long pit assembling structure of a suspension-type envelope enclosure is adopted to construct an underground three-floor basement by the following steps:

I. Design and calculation: Geological conditions of hydrological and geological engineering are researched according to the size of the basement to be constructed and the geological conditions of water-enriched projects near rivers and seas to determine the relationship between the level of the underground water at the position of the basement and the tide of the river and sea water body and the permeability relationships between all soil layers, and then the design number of the floors of the underground structure and the sensitivity of the surroundings are combined to comprehensively determine the pit size and the depth of a pit enclosure 1; the thickness of a basement reinforcing and anti-seeping layer 2 is determined according to the depth of the pit enclosure 1 and the geological conditions. The thickness of the basement reinforcing and anti-seeping layer 2 is determined upon the depth of a pit base plate and the distribution characteristics of an underground layer structure; the position relationship between a waterproof layer and the pit base plate needs to be figured out; the thickness of the waterproof layer below the pit base plate is required to be coordinated with the embedding depth of the wall board of the suspension-type envelope enclosure according to the results of a water-soil coupling analysis of a seepage flow and the stability requirement of a specification-based approach to ensure the stability design of the pit; the following conditions need to be judged, namely whether the pit base plate passes through the waterproof layer, wherein the worst condition is that the pit base plate does pass through the waterproof layer, and whether the waterproof layer exists in a certain range and whether the position of the waterproof layer meets the design requirements; except the case that the waterproof layer with a thickness which meets the design requirements exists below the pit base plate, the soil body in the range of the designed depth of the pit bottom needs to be completely grouted for reinforcement and seepage resistance in other conditions.

Figure 1:
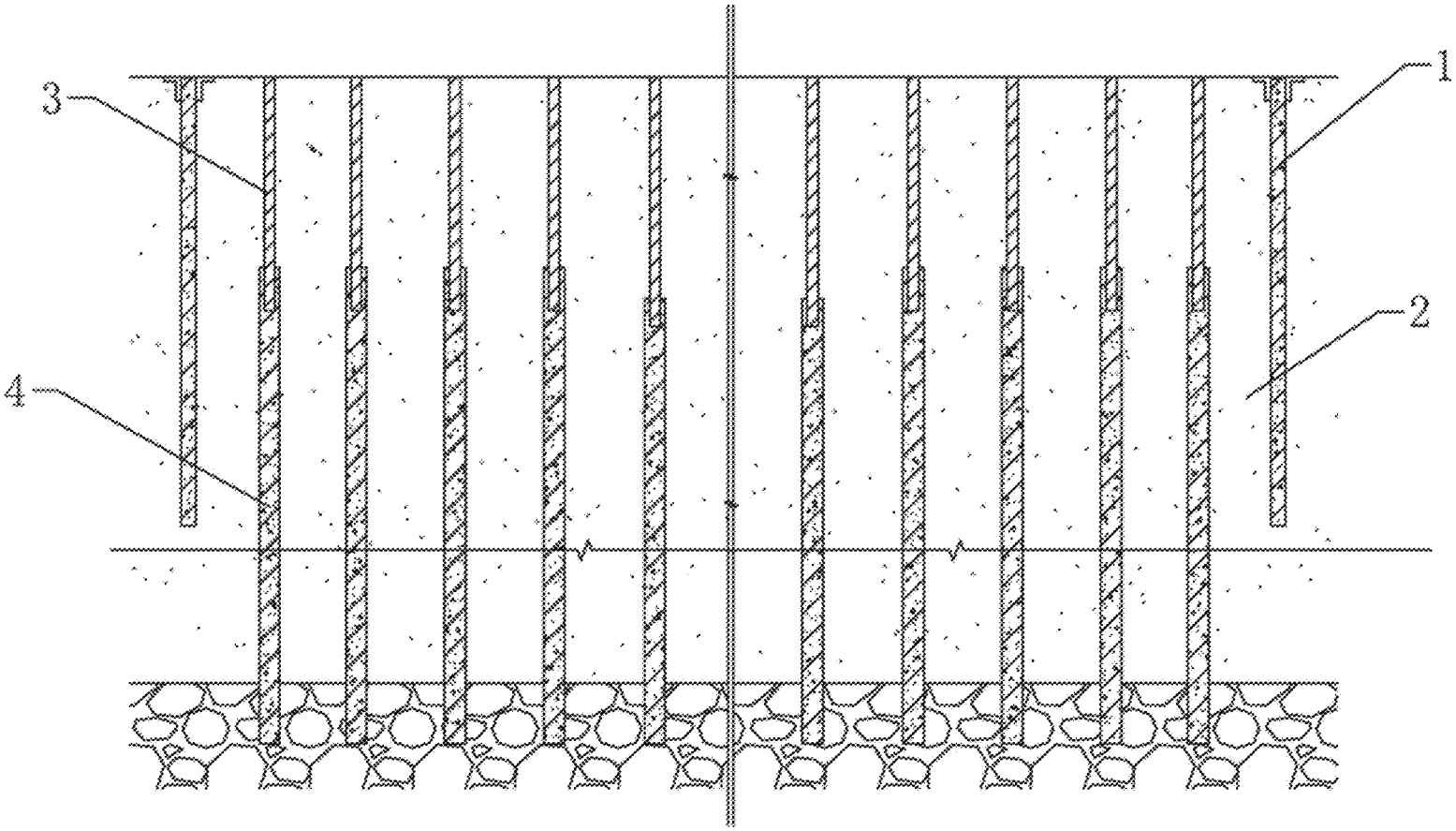
FIG. 1 is a schematic view of a one-column-one-pile structure in the present invention.

II Engineering construction of foundation piles: As shown in FIG. 1, one-column-one-pile construction is adopted in the pit, wherein the one-column-one-pile refers to an integrated structure of a column pile 3 and an engineering pile 4, the engineering pile 4 is a grouting pile while the column pile 3 is a steel pipe concrete column pile, the engineering pile 4 is disposed below the column pile 3, the bottom of the engineering pile 4 is embedded into a waterproof layer or a rock formation, the top of the column pile 4 is constructed to the designed height at one time; during the construction, the verticality of the column pile 3 is ensured, post grouting is carried out at the bottom and the lateral middle portion of the pile to ensure the bearing capability of the column pile 3 and relieve sedimentation.

III. Control over underground water: before the construction of the pit enclosure 1 and the basement reinforcing and anti-seeping layer 2 is completed, the pressure of the underground water is controlled by a method including steps of detecting the cover depth and water head height of the confined groundwater in a construction area, controlling the underground water using a precipitation well and inverted well combined technology in conjunction with the depth of the dug pit to prevent bottom heaving and inrush, and during the soil excavation process and before the construction and strength formation of the basement reinforcing and anti-seeping layer 2, maintaining the pressure of the precipitation well on the confined water layer and keeping working state.

IV Construction of the pit enclosure 1: A supporting wall groove is dug along the outer line of the pit first using a groove milling machine, then the prefabricated wall boards 100 are assembled in the groove to form an underground continuous wall, and the wall is reinforced by grouting after the assembling is completed such that the pit can resist stressed deformation and meet the requirement for stability; the depth of the splicing-type prefabricated wall boards 100 is greater than the depth of a basement floor 6; the top of the underground continuous wall should be provided with a closed reinforced concrete crown beam; the height and width of the crown beam are determined through calculation while the width is better not smaller than the thickness of the underground continuous wall; the underground continuous wall is constructed by section; the top of the wall is provided with a full-length ring-shaped top beam to strength the integrity of the underground continuous wall; the ring-shaped top beam is better leveled with the soil-ward face of the underground continuous wall to maintain a guide wall which plays a role of blocking the soil body and protecting the slope and avoiding adverse effect on surroundings; the underground continuous wall is embedded into the ring-shaped beam by a length of better not smaller than 50 mm, and the length of the longitudinal reinforcing bars that are anchored in the ring-shaped beam is better determined according to tensioning and anchoring requirements.

Figure 7:
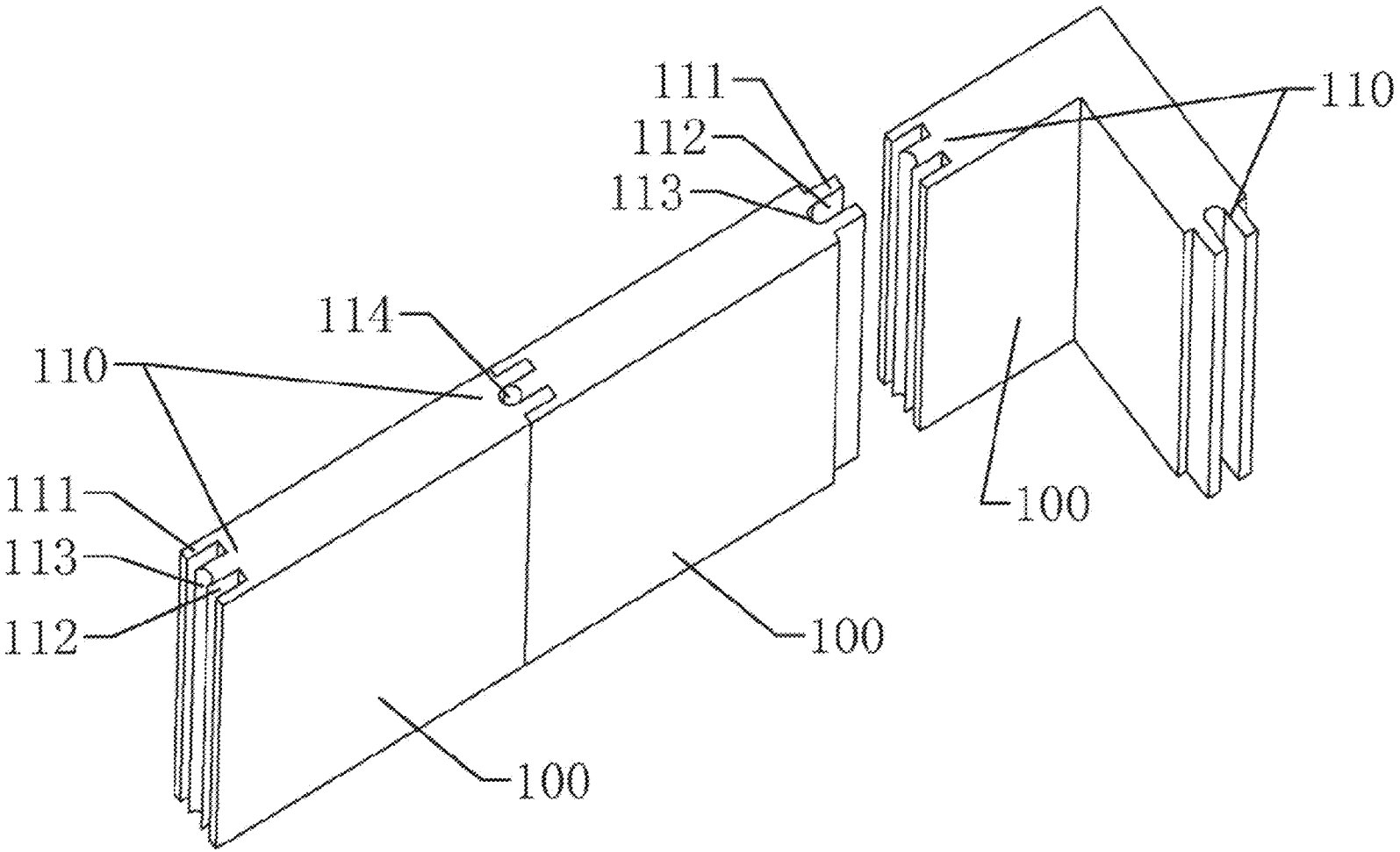
FIG. 7 is a schematic view of assembling of the splicing-type prefabricated wall boards.

According to FIG. 7, each one of splicing-type prefabricated wall boards 100 is provided with splicing portions 110 on two sides; the splicing-type prefabricated wall boards 100 are connected through the splicing portions 110; each one of the splicing portions 110 is internally provided with a grouting semi-opening 113; the grouting semi-openings 113 of two adjacent pieces of the splicing-type prefabricated wall boards 100 are spliced to form a grouting cavity 114; each one of the grouting cavities 114 is internally provided with reinforcing steel bars 115 and concrete; each one of the splicing portions 110 is provided with a splicing strip 111 and a splicing slot 112 which are matched with each other; each one of the splicing-type prefabricated wall boards 100 is formed with an opening 120 in the length direction, and the opening 120 is internally provided with the reinforcing steel bars 115 and the concrete; the splicing-type prefabricated wall boards 100 include flat-plate-type wall boards and bent-type wall boards, and the bent-type wall boards are disposed at the corners of the pit.

Figure 2:
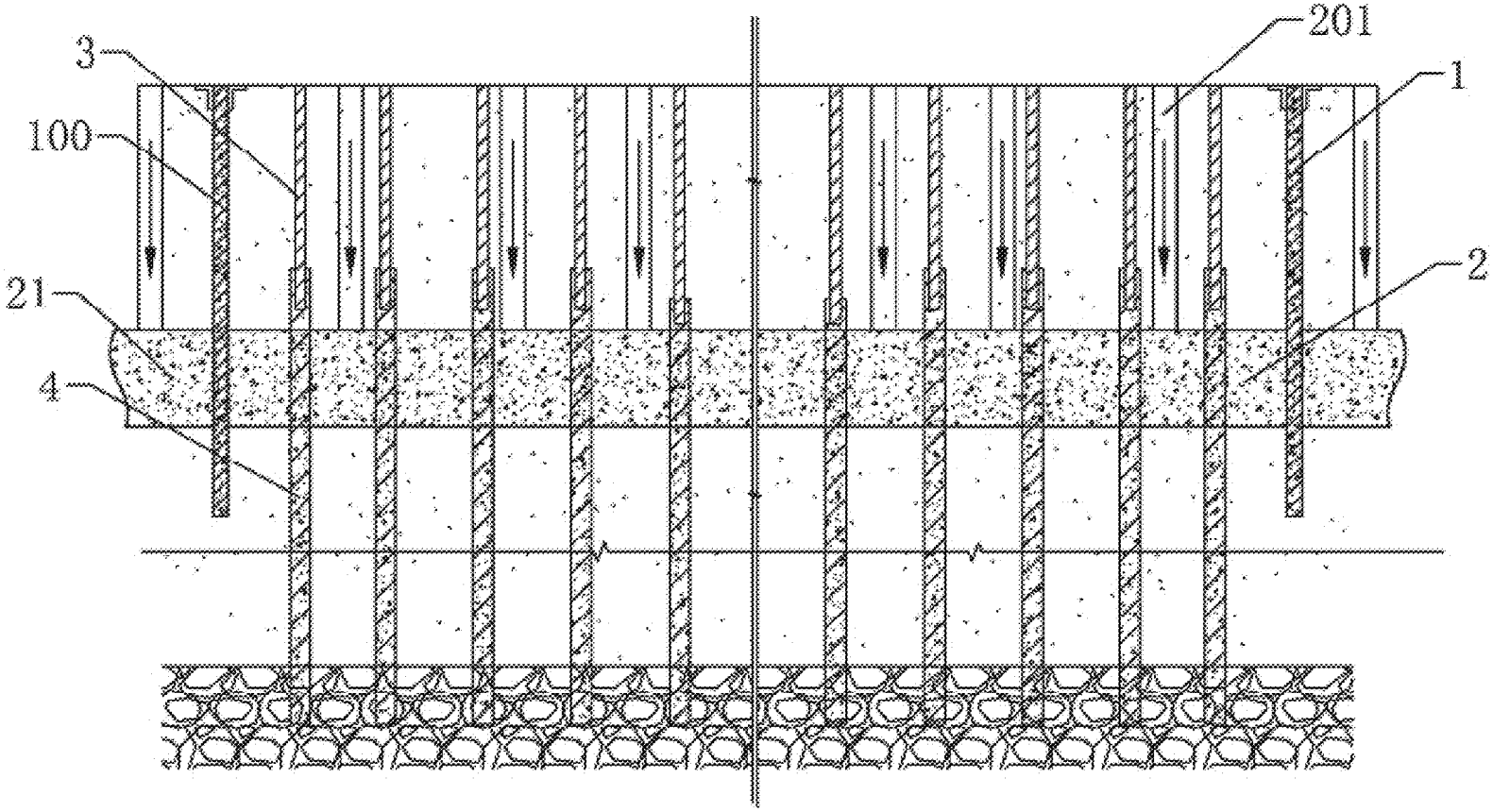
FIG. 2 is a schematic view of a basement reinforcing and anti-seeping layer in the present invention.

V. Construction of the basement reinforcing and anti-seeping layer 2: As shown in FIG. 2, the soil at the bottom of the basement is modified by injecting a grouting material at a high pressure to form a waterproof layer, which is connected with the pit enclosure 1, as the basement reinforcing and anti-seeping layer 2, wherein the basement reinforcing and anti-seeping layer 2 and the pit enclosure 1 form a structure with an "H" longitudinal section, meaning that the depth of the basement reinforcing and anti-seeping layer 2 is greater than the depth of the base plate 6 of the basement and smaller than the depth of the pit enclosure 1; the grouting material is injected from the pit top to the position of the basement reinforcing and anti-seeping layer 2 at a high pressure via grouting holes 201; the grouting holes 201 extend to a position which is 2-4 m below the base plate of the basement; after mud jacking in the grouting holes 201, the basement reinforcing and anti-seeping layer 2 is formed at the bottom of the basement, the thickness of the basement reinforcing and anti-seeping layer 2 is 2-3 m; during high-pressure grouting, an anti-seeping extension layer 21 is grouted outside the pit enclosure 1, and the anti-seeping extension layer 21 extends out of the pit by 1-2 m.

Figure 3:
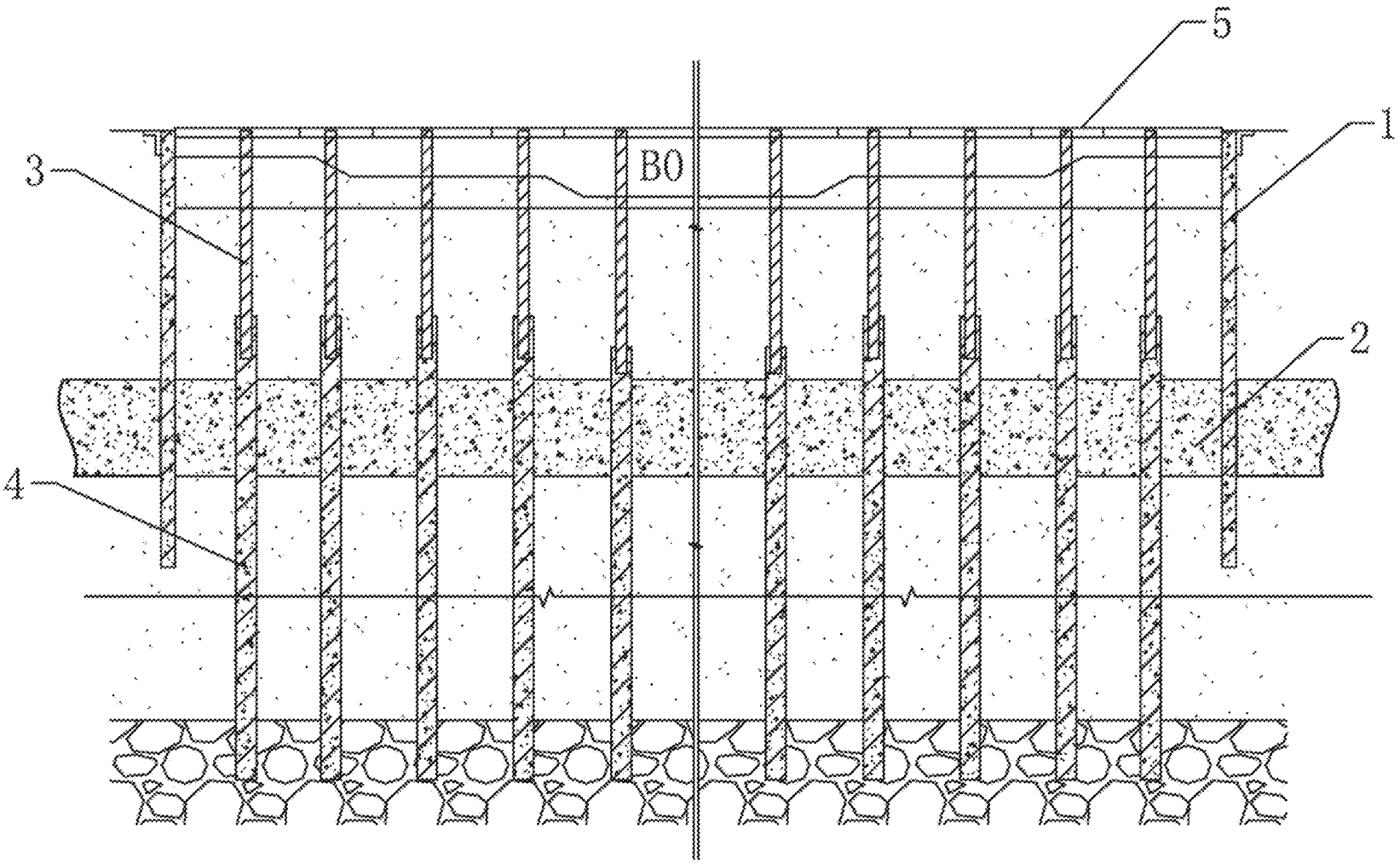
FIG. 3 is a schematic view of soil excavation on floor $B_0$ in an inverse sequence in the present invention.

VI. Inverse construction: A stripping alternative bay method is adopted to excavate the soil, and specifically, the soil is excavated by layer and by zone while the soil next to the wall is retained. The three-floor basement is divided into $B_0$-$B_2$ floors from the ground surface. As shown in FIG. 3, the floor $B_0$ is excavated first, and prefabricated framework beams 5 are set up in the space of the floor $B_0$ after the digging is completed.

Figure 4:
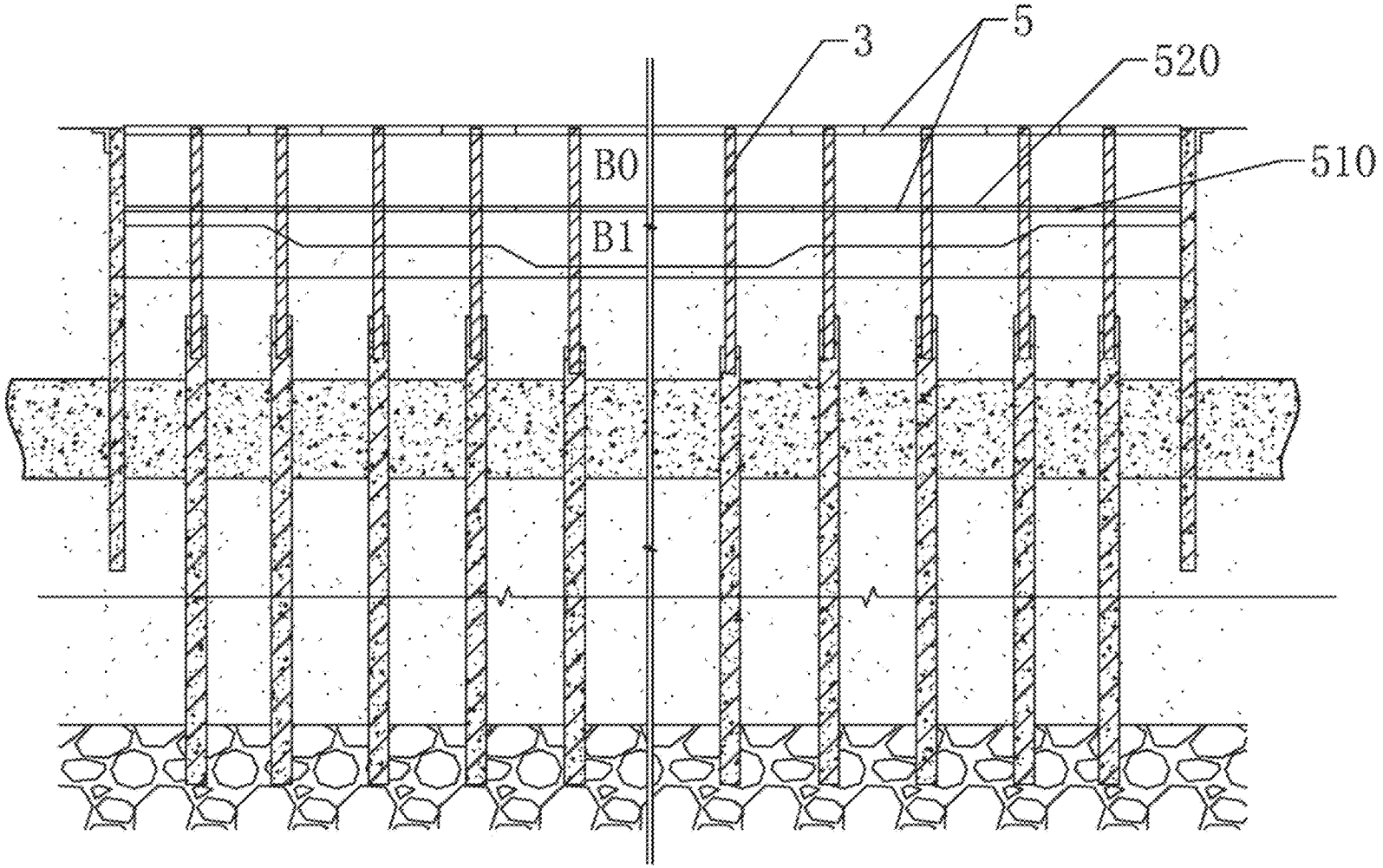
FIG. 4 is schematic view of soil excavation on floor $B_1$ in an inverse sequence in the present invention.
Figure 8:
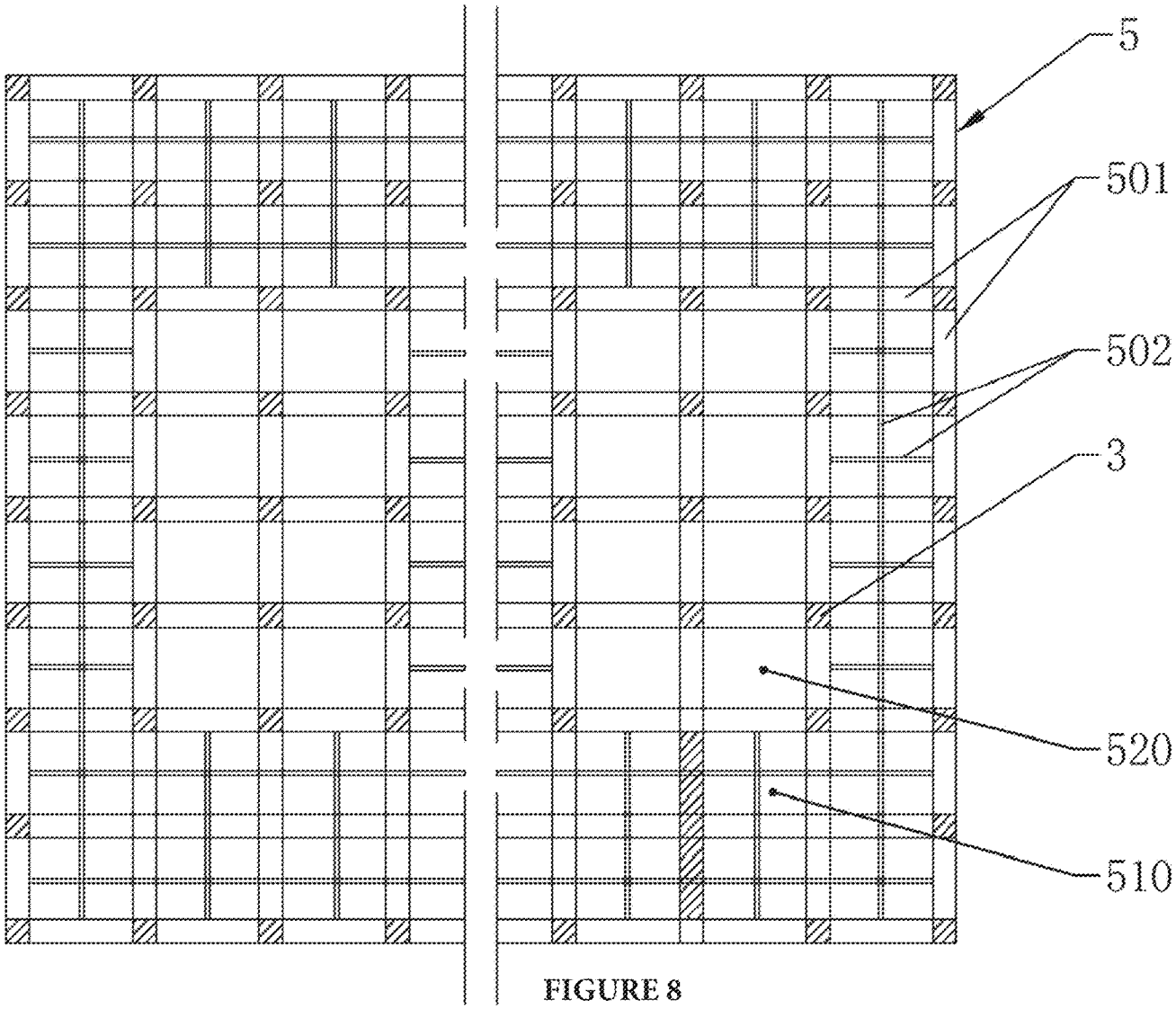
FIG. 8 is a structural view of a prefabricated framework beam in the present invention.

As shown in FIG. 8, each one of the prefabricated framework beams 5 consists of a main beam 501 and a secondary beam 502; the main beam 501 is built into a cross structure; the crossing point of the main beam 501 is disposed at the position of the corresponding one of the column piles 3; the main beam 501 and the secondary beam 502 are overlapped to form a floor-slab superposing area 510; and each one of the prefabricated framework beams 5 includes a slip formwork moving area 520. As shown in FIG. 4, the excavation of the floor $B_1$ and the building of the prefabricated framework beams 5 therein are completed in the same way; the floor B2 is excavated at last, and the bottom face of the basement is poured after digging to form the basement floor 6.

Figure 5:
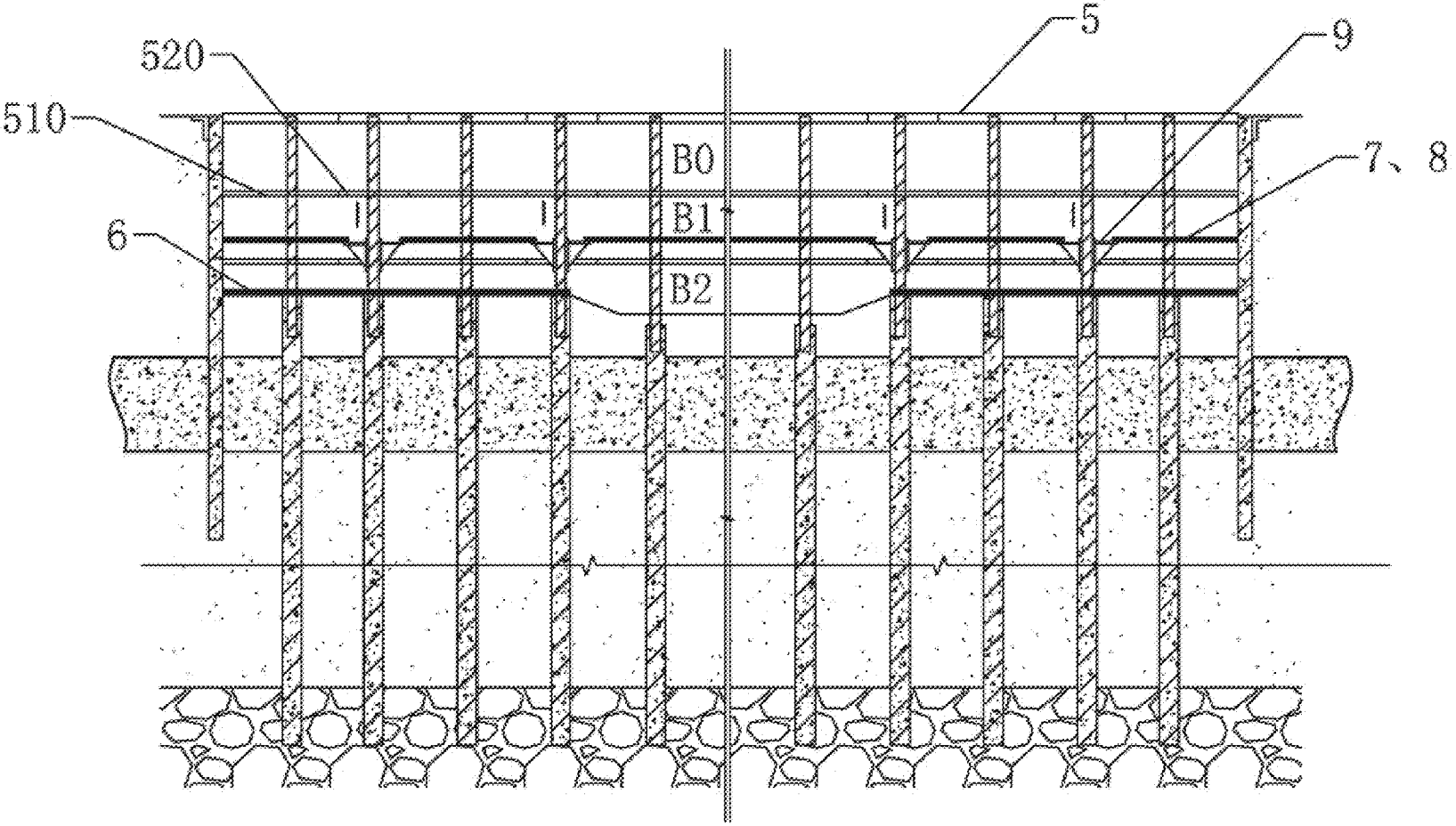
FIG. 5 is a schematic view of a floor-slab structure construction in the present invention.
Figure 6:
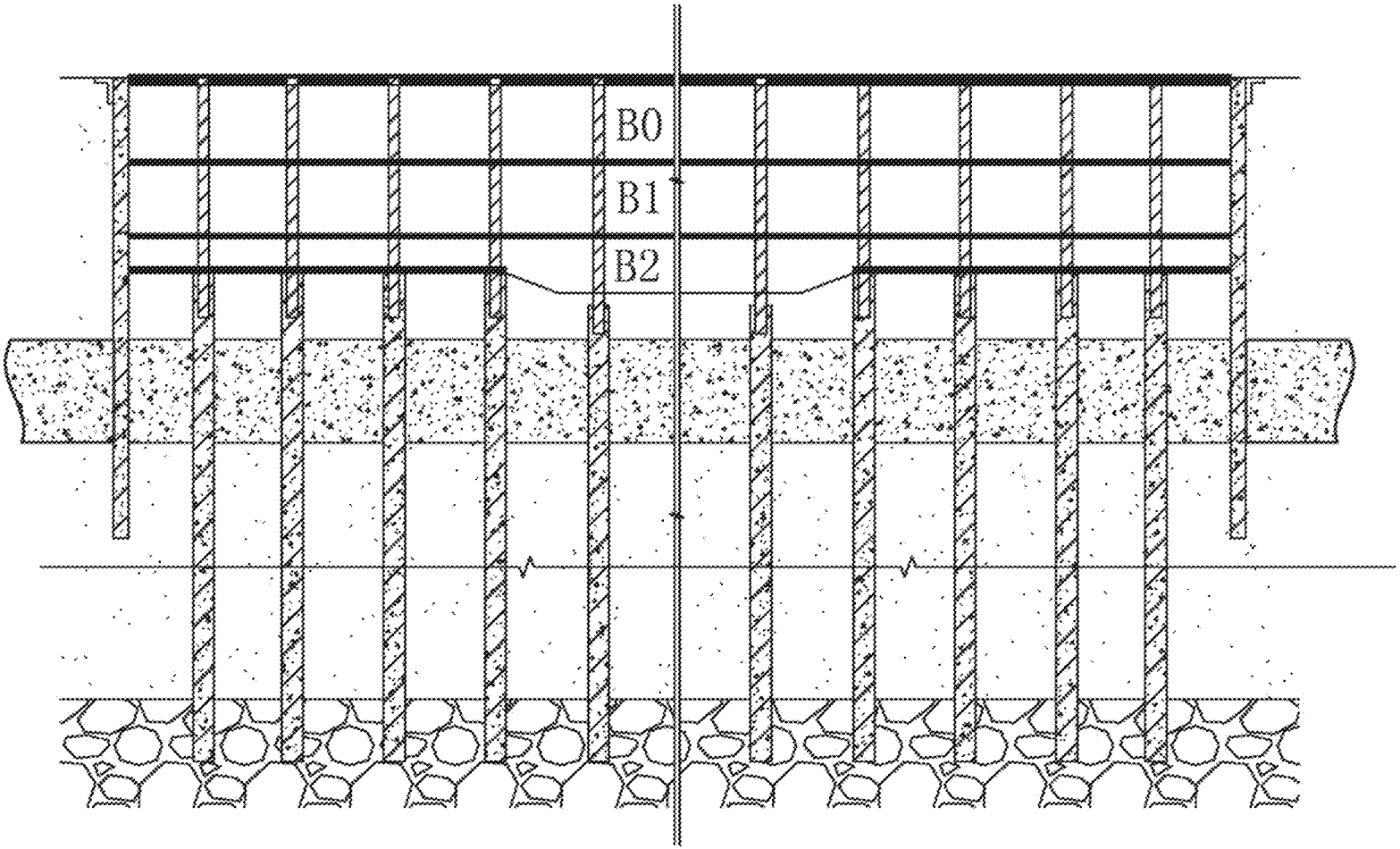
FIG. 6 is a schematic view of a completed basement in the present invention.

VII. Construction of a floor structure: As shown in FIG. 5, construction is carried out upward floor by floor from the floor B2 of the basement, wherein a slip form device 9 is adopted to install prefabricated concrete superposed floor-slabs 7 or profiled sheet combined floor-slabs 8 in the floor-slab superposing area 510; the slip-form device 9 is installed on the column pile 3 and is controlled to go up and down by a hydraulic system; during the construction on each floor, the prefabricated concrete superposed floor-slabs 7 or profiled sheet combined floor-slabs 8 are assembled with the corresponding prefabricated framework beams 5 on each floor; each one of the prefabricated framework beams 5 is provided with an assembling pre-embedded part such that the prefabricated framework beams 5 are connected with the prefabricated concrete superposed floor-slabs 7 or profiled sheet combined floor-slabs 8; then concrete is poured onto the prefabricated framework beams 5 to form integrated floor system and floor slabs after the installation, and when the floor strength reaches 80% of the designed strength, the above steps are repeated to construct the higher floors in sequence, wherein the floor $B_1$ goes first and followed by the floor $B_0$.

Figure 9:
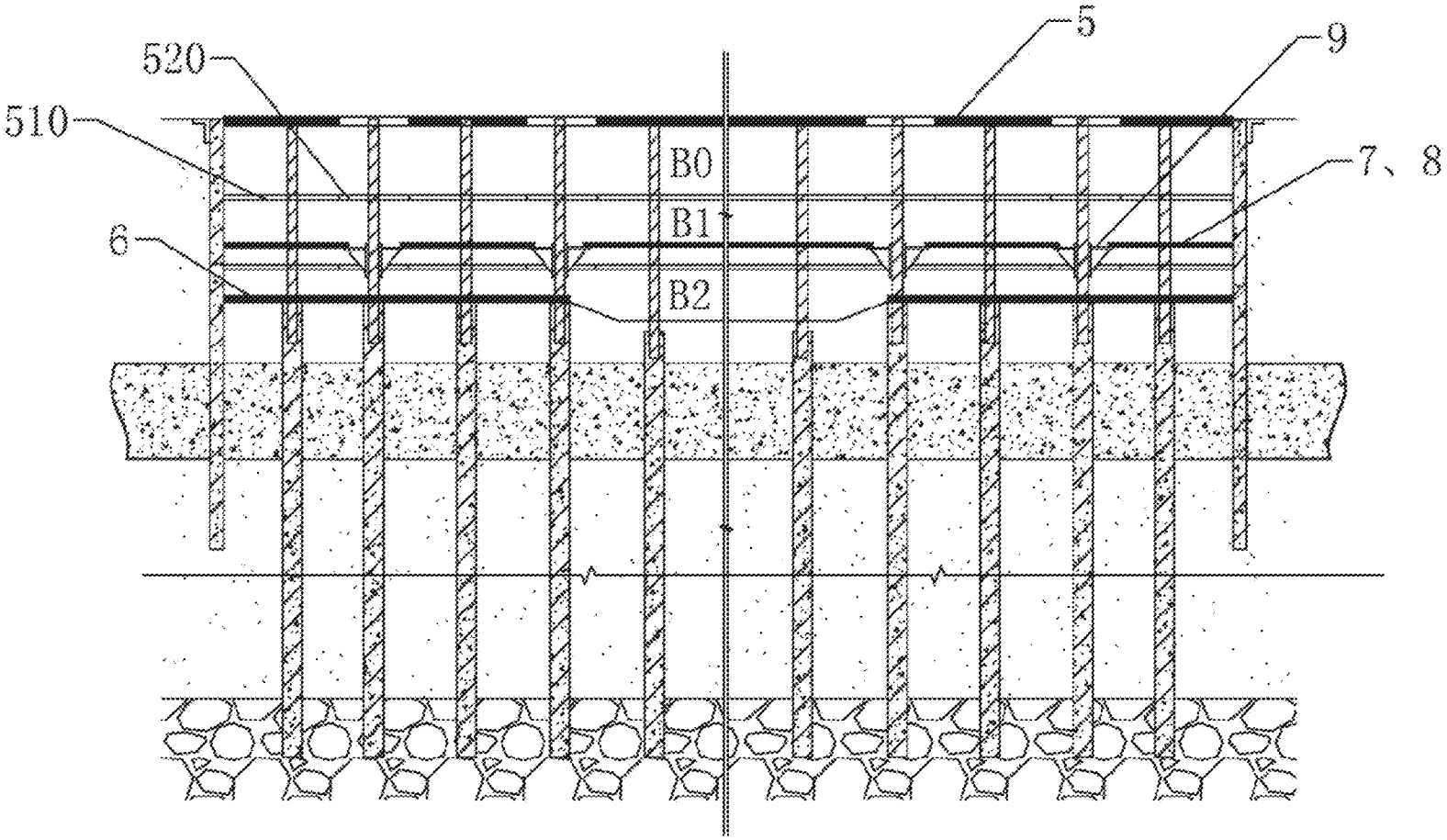
FIG. 9 is a schematic view of embodiment 2 in the present invention.
Figure 10:
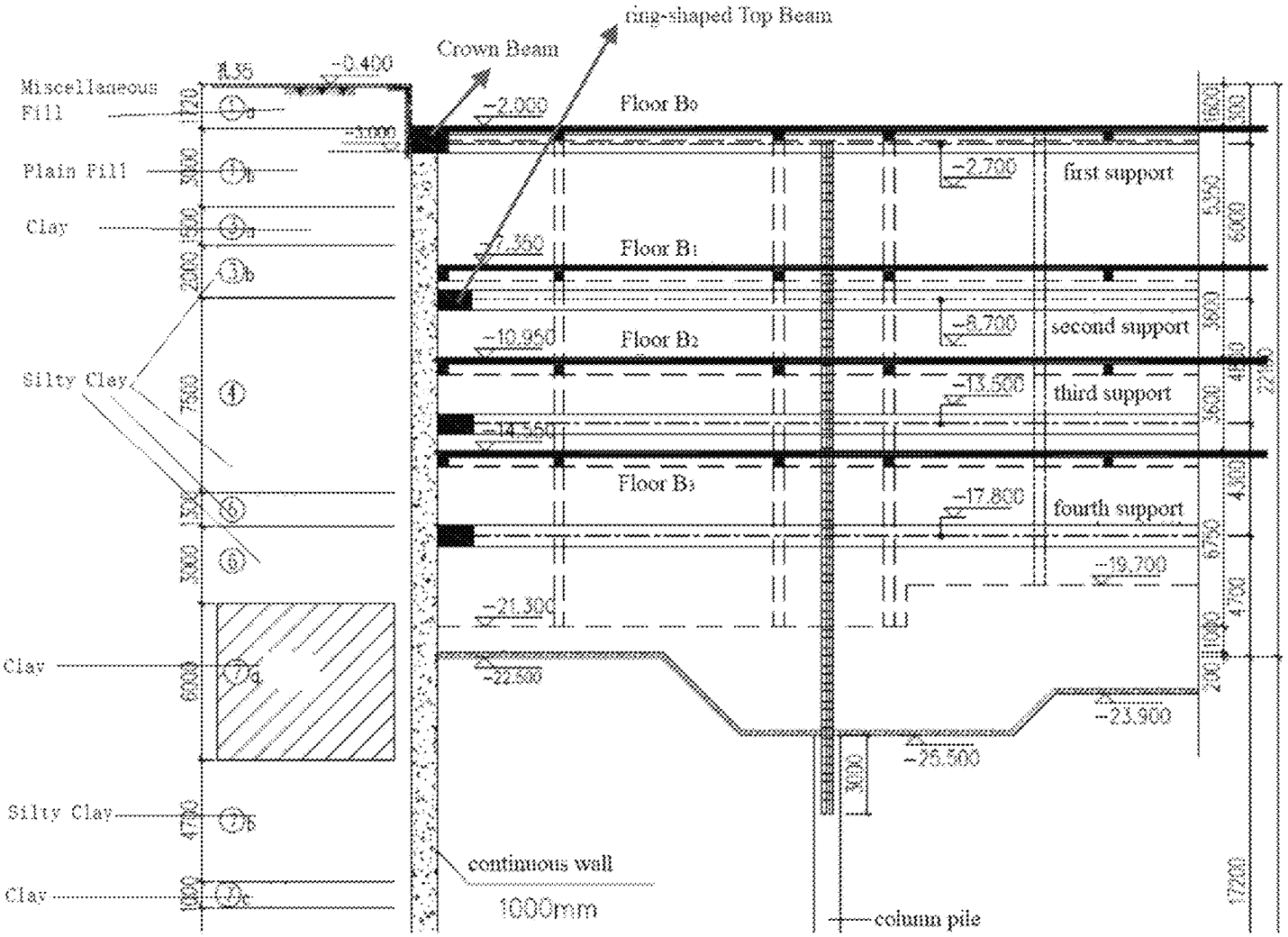
FIG. 10 is a schematic illustrating a structure comprising a ring-shaped top beam and a closed reinforced concrete crown beam.

Embodiment 2:

Embodiment 2 is different from embodiment 1 in that, as shown in FIG. 9, after the building of the pre-fabricated framework beams 5 of the floor $B_0$ is completed, pouring is carried out directly; during pouring, the a slip-form frame moving area 520 of the prefabricated framework beams 5 of such floor is retained as the discharging opening of the excavated soil; then, the excavation of the floor $B_1$ and floor $B_2$ and the building of the prefabricated framework beams 5 therein are carried out downward in sequence, and after the excavation and the building of the prefabricated framework beams 5 are completed, the slip-form 9 device is adopted to install the floor-slabs upward from the floor $B_2$.

What is claimed is:

1. An inverse construction method for a deep, large and long pit assembling structure of a suspension-type envelope enclosure, comprising the following steps:

(I) determining a pit size and depth of a pit enclosure according to a size of a basement to be constructed, and determining a thickness of a basement reinforced anti-seeping layer according to the depth of the pit enclosure and geological conditions;

(II) performing one-column-one-pile construction in the pit, wherein the one-column-one-pile refers to an integrated structure of a column pile and an engineering pile, the engineering pile is disposed below the column pile, the bottom of the engineering pile is embedded into a waterproof layer or a rock formation, the top of the column pile is constructed to the designed height at one time; during the construction, the verticality of the column pile is ensured, post grouting is carried out at the bottom and the lateral middle portion of the pile to ensure the bearing capability of the column pile and relieve sedimentation;

(III) before completing the construction of the pit enclosure and the basement reinforced anti-seeping layer, controlling the pressure of underground water to prevent bottom heaving and inrush;

(IV) digging a groove, forming a continuous wall by mutually assembling splicing-type prefabricated wall boards in the groove, grouting and reinforcing the wall after the assembling is completed such that the pit resists stressed deformation and maintains stability, wherein the depth of the splicing-type prefabricated wall boards is greater than a depth of the basement floor;

(V) modifying soil at the bottom of the basement by injecting a grouting material at a high pressure to form a waterproof layer, which is connected with the pit enclosure, as the basement reinforced anti-seeping layer, wherein the basement reinforced anti-seeping layer and the pit enclosure form a structure with an "H" longitudinal section, meaning that the depth of the basement reinforced anti-seeping layer is greater than the depth of the basement floor and smaller than the depth of the pit enclosure;

(VI) dividing the basement into floors $B_0$-$B_{n+1}$ from the ground surface, digging the floor $B_0$ first, setting up prefabricated framework beams in the space of the floor $B_0$ after the digging is completed, then completing the digging of the floors $B_1$-$B_n$ and setting up of the prefabricated framework beams therein in sequence, and finally digging the floor $B_{n+1}$, and pouring the bottom face of the basement after digging to form the basement floor;

(VII) performing construction upward floor by floor from the floor $B_n$ of the basement, wherein prefabricated concrete superposed floor-slabs or profiled sheet combined floor-slabs are assembled with the corresponding prefabricated framework beams during the construction on each floor, and then concrete is poured onto the prefabricated framework beams to form integrated floor system and floor slabs, and when the floor strength reaches 80% of the designed strength, the construction is continued upward higher floors; and wherein in step III, the pressure of the underground water is controlled by a method comprising steps of detecting the cover depth and water head height of the confined groundwater in a construction area, controlling the underground water using a dewatering well and recharge well combined technology in conjunction with the depth of the dug pit to prevent bottom heave and inrush, and during the soil excavation process and before the construction and strength formation of the basement reinforced anti-seeping layer, maintaining the pressure of the dewatering well on the confined water layer and keeping working state.

2. The inverse construction method for a deep, large and long pit assembling structure of a suspension-type envelope enclosure according to claim 1, characterized in that each one of the splicing-type prefabricated wall boards is provided with splicing portions on two sides; the splicing-type prefabricated wall boards are connected through the splicing portions; each one of the splicing portions is internally provided with a grouting semi-opening; a grouting cavity is formed after splicing the grouting semi-openings of two adjacent splicing-type prefabricated wall boards; and each one of the grouting cavities is internally provided with reinforced steel bars and concrete.

3. The inverse construction method for a deep, large and long pit assembling structure of a suspension-type envelope enclosure according to claim 2, characterized in that each one of the splicing portions is provided with a splicing strip and a splicing slot which are matched with each other; each one of the splicing-type prefabricated wall boards is formed with an opening in the length direction, and the opening is internally provided with the reinforced steel bars and the concrete.

4. The inverse construction method for a deep, large and long pit assembling structure of a suspension-type envelope enclosure according to claim 1, characterized in that during high-pressure grouting in step V, the anti-seeping extension layer is grouted outside the pit enclosure at the same time.

5. The inverse construction method for a deep, large and long pit assembling structure of a suspension-type envelope enclosure according to claim 1, characterized in that the thickness of the basement reinforced anti-seeping layer is determined upon the depth of a pit base plate and the distribution characteristics of a underground layer structure; the position relationship between the waterproof layer and the pit base plate needs to be clear; the thickness of the waterproof layer below the pit base plate is coordinated with the embedding depth of the wall boards of the suspension-type envelope enclosure according to the water-soil coupling analysis of a seepage flow and the stability requirement of a specification-based approach to ensure the stability design of the pit; the following conditions need to be judged, namely whether the pit base plate passes through the waterproof layer, wherein the worst condition is that the pit base plate does pass through the waterproof layer, and whether the waterproof layer exists in a certain range and whether the position of the waterproof layer meets the design requirements; except the case that the waterproof layer with a thickness which meets the design requirements exists below the pit base plate, a soil body in the range of the designed depth of the pit bottom needs to be completely grouted for reinforcement and seepage resistance in other conditions.

6. The inverse construction method for a deep, large and long pit assembling structure of a suspension-type envelope enclosure according to claim 1, characterized in that in step IV, a supporting wall groove is dug along the outer line of the pit first using a groove milling machine, then the prefabricated wall boards are assembled in the groove to form an underground continuous wall of which the top is provided with a closed reinforcing and concrete crown beam; the height and width of the crown beam are determined through calculation while the width is better not smaller than the thickness of the underground continuous wall; the underground continuous wall is constructed by section; the top of the wall is provided with a full-length ring-shaped top beam to strength the integrity of the underground continuous wall; the ring-shaped top beam is better leveled with the soil-ward face of the underground continuous wall to maintain a guide wall which plays a role of blocking the soil body and protecting the slope and avoiding adverse effect on surroundings; the top of the underground continuous wall is embedded into the ring-shaped beam by a length of better not smaller than 50 mm, and the length of the longitudinal reinforcing and bars that are anchored in the ring-shaped beam is better determined according to tensioning and anchoring requirements.

7. The inverse construction method for a deep, large and long pit assembling structure of a suspension-type envelope enclosure according to claim 1, characterized in that in step V, the grouting material is injected from the pit top to the position of the reinforced anti-seeping layer at a high pressure via grouting holes; the grouting holes extend to a position which is 2 to 4 m below the base plate of the basement; after mud jacking in the grouting holes, the basement reinforced anti-seeping layer is formed at the bottom of the basement, and the thickness of the basement reinforced anti-seeping layer is 2 to 3 m.

8. The inverse construction method for a deep, large and long pit assembling structure of a suspension-type envelope enclosure according to claim 1, characterized in that in step VI, each one of the prefabricated framework beams consists of a main beam and a secondary beam; the main beam is built into a cross structure; the crossing point of the main beam is disposed at the position of the corresponding one of the column piles; the main beam and the secondary beam are overlapped to form a floor-slab superposing area; each one of the prefabricated framework beams comprises a slip formwork moving area; and in step VII, a slip formwork is adopted to install pre-stress concrete superposed floor-slabs or profiled steel combined floor-slabs in the floor-slab superposing area.

9. The inverse construction method for a deep, large and long pit assembling structure of a suspension-type envelope enclosure according to claim 1, characterized in that in step VII, each one of the prefabricated framework beams is provided with an assembling pre-embedded parts which are used to be connected with the pre-stress concrete superposed floor-slabs or profiled steel combined floor-slabs.

10. The inverse construction method for a deep, large and long pit assembling structure of a suspension-type envelope enclosure according to claim 1, wherein the splicing-type prefabricated wall boards include flat-plate-type wall boards and bent-type wall boards.

11. The inverse construction method for a deep, large and long pit assembling structure of a suspension-type envelope enclosure according to claim 1, wherein in step VI, a stripping alternative bay method is adopted to excavate the soil, and specially, the soil is excavated by layer and by zone while the soil next to the wall is retained.

* * * * *